United States Patent [19]

Phillips

[11] 4,223,875

[45] Sep. 23, 1980

[54] APPARATUS FOR DESKULLING TUNDISHES AND SIMILAR VESSELS

[75] Inventor: Raymond J. Phillips, Matlock, England

[73] Assignee: Alexander Shand Services Limited, Matlock, England

[21] Appl. No.: 17,670

[22] Filed: Mar. 5, 1979

[30] Foreign Application Priority Data

May 30, 1978 [GB] United Kingdom ..... 24507/78

[51] Int. Cl.[3] ..... F27D 23/02

[52] U.S. Cl. ..... 266/135; 266/280; 266/287

[58] Field of Search ..... 266/135, 280, 281, 160, 266/287, 245; 299/70; 173/43, 35

[56] References Cited

U.S. PATENT DOCUMENTS

| | | | |
|---|---|---|---|
| 3,348,833 | 10/1967 | Long et al. | 266/135 |
| 3,370,654 | 2/1968 | Skendrovic | 266/135 |
| 3,438,619 | 4/1969 | Forstes | 266/135 |
| 3,458,396 | 7/1969 | Grant | 299/70 |
| 3,627,291 | 12/1971 | Montgomery et al. | 266/135 |
| 4,095,306 | 6/1978 | Norton | 299/70 |

*Primary Examiner*—L. Dewayne Rutledge
*Assistant Examiner*—Peter K. Skiff
*Attorney, Agent, or Firm*—Sughrue, Rothwell, Mion, Zinn and Macpeak

[57] ABSTRACT

An apparatus for deskulling tundishes comprises a support for holding a tundish to be deskulled in upright or inverted position and an impact hammer mounted on a carriage and movable longitudinally and transversely relative to the tundish whereby the latter can be deskulled. The tundish, when deskulled, is tilted to tip the skull bricks into a pit.

1 Claim, 2 Drawing Figures

APPARATUS FOR DESKULLING TUNDISHES AND SIMILAR VESSELS

This invention relates to apparatus for deskulling tundishes and similar vessels.

The customary method of deskulling a tundish is to invert same so that the solidified slag can be easily knocked out by impacting through the underside of the tap holes of the tundish. In this way, the skull can be quickly knocked out, often falling away as a single piece leaving the refractory lining of the tundish intact.

It is an object of the present invention to mechanise this deskulling operation.

According to the present invention there is provided apparatus for deskulling tundishes and similar vessels comprising, for location adjacent a pit means for mounting a tundish in upright position, and an impact hammer movable longitudinally and tranversely across the pit for deskulling the tundish.

Preferably, the means mounting the tundish is tiltable whereby after the impact hammer has deskulled the tundish the latter can be tilted to tip the skull into the pit.

Preferably, the impact hammer is carried by an articulated boom carried by a carriage movable transversely and longitudinally of the pit.

Preferably, the carriage is movable transversely of a gantry bridging the pit, which gantry is movable longitudinally of the pit.

Preferably, the carriage is movably along rails on the gantry which, in turn, is movable along elevated rails at each side of the pit.

An embodiment of the present invention will now be described, by way of example, with reference to the accompanying drawings, in which.

Figure 1:
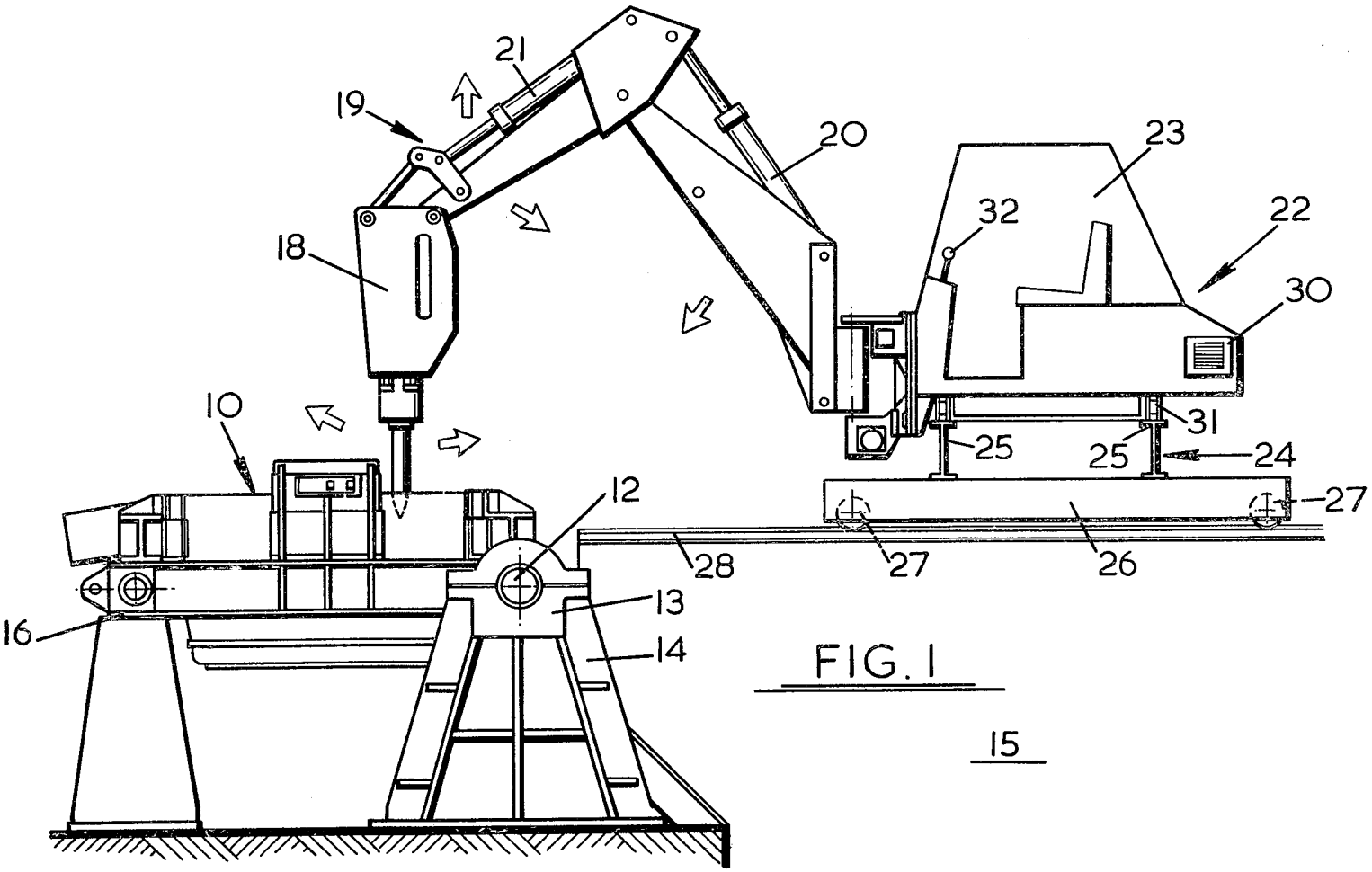
FIG. 1 is a side elevation of apparatus according to the invention.
Figure 2:
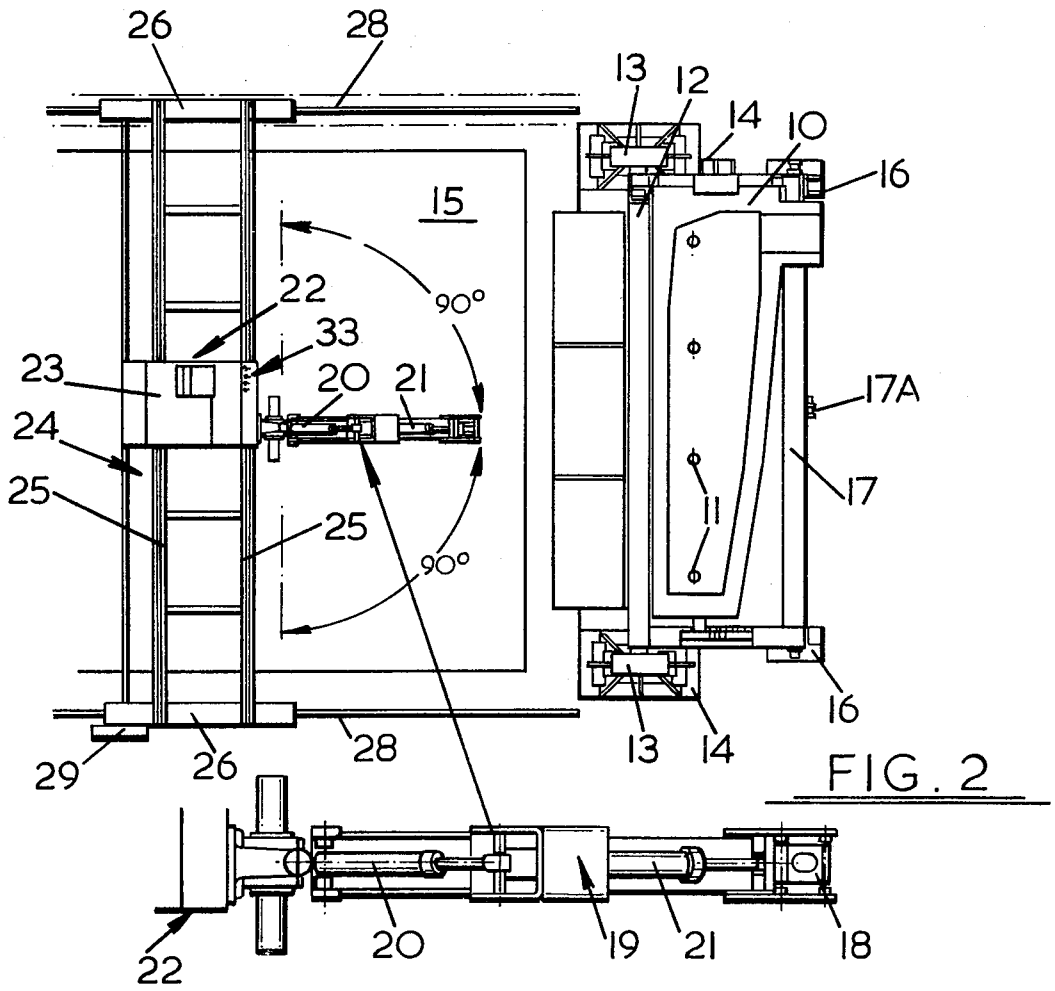
FIG. 2 is a corresponding plan view.

The tundish to be deskulled is generally indicated at 10, the tap holes being referenced 11. The tundish tilting mechanism pivot shaft 12 is mounted in bearings 13 carried by stands 14 disposed at the edge of a rubble pit 15. The tundish 10 at its other end is supported by two support pedestals 16, a tilt mechanism cross-shaft 17 being provided which has an attached clevis 17A such that with the aid of an overhead crane the tundish 10 can be tilted to cause the skull brickwork loosened as described later to tip into the pit 15.

The deskulling operation which may also include the dressing or complete delining of the tundish is effected by a hydraulic or pneumatic impact hammer 18. This hammer 18 is carried by an articulated boom 19 which gives to the hammer 18 adjustable reach and angle. The boom 19 is hydraulically operated and has a 180° slewing action and additionally is controlled by a boom lift and lower ram (not shown), a boom dipper lift and lower ram 20 and a cradle (knuckle) ram 21.

It will be manifest that the impact hammer can thus be positioned relative to the tundish thoroughly to deline same.

The boom 19 is mounted on a carriage 22 which has a cabin 23 for the hammer operator.

The carriage 22 is mounted for movement transversely of the pit 15 on a gantry 24 mounting rails 25, defined by heavy structural steel I-section girders mounted at each side of the pit 15 on end carriages 26.

The end carriages 26 are formed of heavy structural steel sections and each has two large-diameter double flanged steel tram wheels 27 which run on rails 28 along the pit sides. One of the tram wheels 27 of each carriage 26 are driven through a spur ring (not shown) having its own independent drive comprising a motor, brake and enclosed reduction gear generally indicated at 29. The brakes operate automatically when the motors are deenergised.

Anti-tilting devices (not shown) are fitted to the carriages 26 to prevent it lifting from rails 28.

Carriage 22 carries a hydraulic power pack unit 30 powered by an electric motor and is supported on wheels 31 running on rails 25. The drive for the carriage 22 is similar to that for the gantry 24 and incorporates brakes automatically operable when the driving motors are stopped.

Anti-tilt devices (not shown) are fitted to carriage 22.

The operator effects transverse and longitudinal travel movements via a joystick control 32. The boom movements and hammer firing are effected through manually-operated directional control valves 33. A separate on/off switch (not shown) is provided to control the power pack motor.

In use, the hammer 18 deskulls and delines the tundish 10, the hammer being presented to the tundish 10 in whatever manner is required due to controlled carriage and boom movements. The gantry 24 is then moved back from the tundish which is tipped to deposit the slag bricks in the pit.

What is claimed is:

1. An apparatus for deskulling and delining tundishes and similar vessels, comprising: a pit for receiving loosened skull brickwork and other rubble, stand means at a first side of said pit to which one end of a tundish is pivotably mounted for tilting loosened skull brickwork and other rubble into the pit, support means for supporting another and opposite end of said tundish during a deskulling operation, parallel rail means along two other sides of said pit, a wheeled gantry bridging the parallel rail means and movable along said parallel rail means above said pit towards and away from said first pit side, a carriage mounted on said gantry for movement therealong in a direction parallel with said first pit side, a slewable and articulated boom mounted at one end on said carriage, and an impact hammer carried at the other end of said boom for effecting the deskulling of a tundish.

* * * * *